US006533212B1

(12) United States Patent
Tafel, II

(10) Patent No.: US 6,533,212 B1
(45) Date of Patent: Mar. 18, 2003

(54) WEB-SPLICING APPARATUS

(75) Inventor: Leonard I. Tafel, II, Mount Prospect, IL (US)

(73) Assignee: Jarvis Industries, Inc., Itasca, IL (US)

( * ) Notice: Subject to any disclaimer, the term of this patent is extended or adjusted under 35 U.S.C. 154(b) by 0 days.

(21) Appl. No.: 09/655,694

(22) Filed: Sep. 6, 2000

(51) Int. Cl.[7] ..... B65H 19/10; B65H 69/06
(52) U.S. Cl. ..... 242/554.6; 242/559
(58) Field of Search ..... 242/554.6, 551, 242/555.3, 558, 559, 559.1, 559.3, 559.4

(56) References Cited

U.S. PATENT DOCUMENTS

| | | | | |
|---|---|---|---|---|
| 1,932,642 A | | 10/1933 | Schmidt | |
| 2,130,233 A | | 9/1938 | Greenwood | |
| 3,071,333 A | | 1/1963 | Looser | |
| 3,637,155 A | | 1/1972 | Pato | |
| 3,740,296 A | | 6/1973 | McDonald | |
| 3,831,876 A | | 8/1974 | Phelps | |
| 4,729,522 A | | 3/1988 | Tafel | |
| 4,948,060 A | * | 8/1990 | Kurz et al. | 242/559.4 |
| 5,025,998 A | * | 6/1991 | Hutzenlaub et al. | 242/559.1 |
| 5,697,575 A | | 12/1997 | Moore | |
| 6,241,179 B1 | * | 6/2001 | Hachiya et al. | 242/555.3 |

FOREIGN PATENT DOCUMENTS

| | | |
|---|---|---|
| EP | 0 064 941 | * 11/1982 |
| JP | 1-261150 | * 10/1989 |
| JP | 1-267244 | * 10/1989 |

* cited by examiner

*Primary Examiner*—William A. Rivera
(74) *Attorney, Agent, or Firm*—Frederick J. Otto

(57) ABSTRACT

An improved web splicing apparatus that permits better handling of rolls of paper and other materials and the automatic splicing of the beginning of one roll of paper onto the approximate end of a second roll of paper without discontinuing the flow of paper to the utilizing device and without the use of core shafts. The apparatus utilizes two opposed pairs of independently controlled and positioned web roll support arms which are pivoted about spaced shafts and rotatably support cores of the paper rolls. This invention also allows sequential splicing of rolls having unequal web widths. This configuration also allows the right and left roll support arms to move the rolls upward in an overlapping path from a single loading position, thus providing a machine having considerably reduced dimensions and floor-space requirements. Another aspect of this invention is the automatic ejection of depleted roll-cores. A further aspect is the feasibility of configuring a stacked system of multiple splicers by rotating the splicers one quarter of a revolution, allowing machines to be stacked on top of one another to reduce floor space. Yet another aspect of this invention is the ability to remove partially depleted rolls without interrupting the feed of the web. Still another aspect is the use of the motor in conjunction with the brakes to expand the core chucks to grip the inside of the roll cores.

16 Claims, 6 Drawing Sheets

WEB-SPLICING APPARATUS

BACKGROUND OF THE INVENTION

The present invention relates to apparatus and method to form a flying splice to a new roll from a web of material running from an expiring roll. Specifically, such splicers join together the leading end of a web from a new roll of material to a web which is being drawn from a substantially depleted roll, and which is being run, under tension, along a predetermined path of travel to a utilizing device. Examples of such splicing arrangements are seen on conventional turret splicers.

In the past, several different types of pivoting roll supports have been used in flying splicers, including "Three-Arm Turret Splicers" and "Two-Arm Turret Splicers" and several splicers by the present inventor which move the rolls in a linear path. The turret types have several significant disadvantages: means to sequentially accept rolls of unequal lengths and means to automatically expel empty roll cores are complex and costly, and they have a floor length in the direction web travel exceeding twice the maximum roll diameter and additionally require over a diameter between every-other machine for loading access, for a total length, on average, of three times the roll diameter. The linear path types are stackable vertically and therefore more compact than the turret types, but use coreshafts, and stacking requires platforms, ladders, and roll-lifting means. Although linear types are able to effectively expel the 90 pound core shafts with the depleted rolls still attached, the operator must manually lift the heavy depleted roll and core shaft down from the splicer, release and remove the coreshaft from the expired roll, reassemble the coreshaft into a new roll and re-engage the gripping mechanism within the coreshaft.

As commonly used on printing presses, the press itself is situated on the ground floor and beneath this floor are the splicers that feed up into the press. As each web may equal only 4 or 8 newspaper pages, multiple webs of paper are required. The minimum printing unit spacing is normally approximately 137 inches and the turret type splicers average three times the roll diameter, or 150 inches. Thus a newspaper of 16 units, producing a newspaper having 64 pages would have a splicer row in excess of 16 feet longer in the direction of web travel than the press row. Further, much engineering design is wasted in designing the interface between the splicers and the presses on a custom basis for each installation occasioned by their unequal lengths. Also, there are frequently length restrictions imposed by existing buildings and real-estate lots which preclude lengthening the buildings wherein the press rows are housed.

Sequentially loading rolls of different widths is desirable as it permits make-ready on scrap rolls of various widths and facilitates a rapid startup on subsequent press runs as a web width required for the next product to be printed may be already threaded, allowing the personnel customarily assigned to the duty of changing roll sizes and threading the press to be available for other duties involved in the changeover to a new product. As it is sometimes necessary to splice before the expiring roll is depleted, whether because of a problem with the roll of material, or because of a need to change web widths, the present invention teaches designing an opening in the frame side plate and means to move the arms away from the roll after the roll weight is transferred to the roll removing means, to allow axial removal of the previous partial roll.

Exemplary of patented continuous roll feeding devices are the following U.S. Patents: Schmidt, U.S. Pat. No. 1,932, 642, and Looser U.S. Pat. No. 3,071,333 both teach four independently rotatable arms about a common pivot shaft, and Looser has the additional disadvantage of requiring core shafts. Positioning the arms on a common shaft precludes independent lateral positioning and also the automatic core ejection as described herein, which are both prime objects of the present invention.

The Pato U.S. Pat. No. 3,637,155 shows two pairs of arms mounted on two parallel shafts but specifically states the one set of arms is "spaced laterally outwardly from the support arms of the second pair . . . " whereas the objectives of the present invention require independent lateral positioning of the pairs of support arms. In addition, the claims of the Pato patent specifically state that the arms be of different lengths, whereas in the present invention, it is not necessary that the pairs of arms bear any length relationship to one another whatsoever.

The McDonald U.S. Pat. No. 3,740,296 teaches the use of two pairs of arms mounted on separate parallel shafts, but the configuration is such that the horizontal distance required for a splicer exceeds twice the roll diameter whereas the present invention requires less than one and one-half times the roll diameter. Furthermore, the McDonald design requires two splicing mechanisms and two separate load positions.

The Phelps et. al. U.S. Pat. No. 3,831,876 teaches supporting of the rolls having roll core shafts with four arms on a common arm support shaft.

The Tafel U.S. Pat. No. 4,729,522 requires roll coreshafts, and even if it were feasible to adequately support moving and retractable core chucks on an endless chain, it would still not be feasible to splice sequential rolls of different length as permitted in the present invention because the chucks would have to be on separate endless chains which would interfere with one another.

The Moore U.S. Pat. No. 5,697,575 teaches a splicer having an overall width of less than twice the maximum roll diameter wherein two core chucks traverse opposite sides of the same vertical rail on both the operating and drive sides. Because both chucks are on the same vertical rail, and thus horizontally spaced the same distances as their opposing chuck, this design precludes splicing rolls of varying width. To avoid this problem, four separate vertical rails might be used, one for each of the four chucks, two on the operator side and two on the drive side. However, interference between said vertical rails and the ends of the rolls would occur if the roll widths were unequal as permitted in the present invention.

To integrate sequential splicing of rolls of varying width into the prior art requires either (a) the use of core shafts longer than the widest roll, which would defeat one of the prime objects of the present invention, the elimination of core shafts, or (b) independent axial positioning of the roll support arms, which precludes positioning said arms on a common shaft, as it is necessary for each pair of arms to carry rolls having a length that either is less than or surpasses the length of the other pair. A common roll support arm shaft also precludes the automatic core ejection as described herein, which is another prime object of the present invention.

SUMMARY OF THE INVENTION

Definition of Terms

It will be useful to define certain terms: the term "splicehead" refers collectively to the resilient roll, its supporting frame, the severing knife and its actuator. The term "splicer" refers collectively to the entire roll unwinding, tension control mechanism and splicehead. The term "chucking means" refers collectively to the internal core supports, located parallel to the pivot shafts on which the arms rotate, and rotatably mounted on the end away from said shafts, which are operatively expandable to grip the insides of the roll cores and rotate therewith. The term "butt roll" refers to a core having only a reduced amount of paper remaining wound upon it. The term "arm" refers collectively to a rigid structure having parallel holes in each end, one end pivoting on a shaft parallel to the axis of the rolls and the other end having a chuck support shaft on bearing means contained therein rotatably supporting its chuck, means to apply torque to the chuck, and sensing means located thereon to determine the position of the surface of the roll and to confirm the completion of mechanical motions. The term "computer" refers to a control device, either an analog or preferably a digital device for speed and economy, which provides control signals to operatively regulate the motions of the splicer elements logically responsive to manual and automatic sensor signals. The term "new roll" refers to the most recently loaded roll onto which the end of the expiring roll will be joined. The term "roll cores" refers to a tube of length substantially equal the width of the web onto which the web is wound. The term "operator side" refers to that side of the machine closest to the operator into which the roll is preferably loaded. The term "drive side" refers to the side farthest away from the operator. The term "non-driven side" refers to the side of the splicer opposite the core driving motor. The term "driven side" refers to the side of the splicer that has the chuck rotatably driven by the motor. The term "linear actuator" refers to an operative means activating a screw or rack assembly which is operatively contractible or extensible responsive to operative means connected thereto, or a pneumatic or hydraulic cylinder to provide a lifting means for said arms. The term "web" refers to a thin ribbon of flexible martial, such as paper, cardboard, plastic, foil, fabric or the like. The term "dancer" refers to a roller mounted between swinging arms which are adjustably biased by spring, pneumatic or electrical actuators, said actuators so disposed as to resist rotation of said arms by a web wrapped around said roller, the rotational position of said arms producing an electrical signal responsive to the angular position which is indicative of the tension force of said webs. The term "core shaft" refers to a commercially available device consisting of a tube having a diameter smaller than the inside diameter of the roll core into which it is inserted, journaled ends, and a length exceeding the length of the roll of material it supports, and which is provided with expansion means to forcibly engage the interior of said core.

BRIEF DESCRIPTION OF THE DRAWINGS

In the detailed description of the invention which follows, reference will be made to the accompanying drawings composed of the following figures.

DETAILED DESCRIPTION OF THE PREFERRED EMBODIMENT

The present invention relates to methods and apparatus to form a flying splice wherein the new and expiring rolls of material are supported on a roll unwind stand, where the expiring roll is rotatably supported between a first pair of support arms, and where a new roll with an adhesive pattern is rotatably supported between a second pair of support arms such that the plane of the path of the expiring roll is above, but not touching, the surface of the new roll. When the expiring roll is depleted to a predetermined diameter, the running web is pressed against the surface of the revolving new roll he splicehead, joining the adhesive areas to the running web. The web leading from the expiring roll is severed by a knife which is part of the splicehead. The knife on the splicehead is responsive to a signal from the computer means.

Further, the present invention relates to an improved apparatus and method supplying a continuous web of material at substantially constant speed and tension from a succession of web supply rolls. While reference is made to rolls of paper, it will be understood that the webs may be formed of any thin flexible material, such as paper, plastics, textiles, metal foils and the like, and while reference is made to printing, other web processing devices may be substituted.

More particularly, the present invention relates to an improved splicing machine having the following advantages:

(1) improved structures for loading and rotatably supporting rolls having unequal widths, without the use of core shafts (2) reduced overall dimensions, specifically, a length less than twice the roll diameter.

(3) an economical and simple way of removing rolls that are rejected after being only partially depleted from the splicer without interrupting the web supply.

(4) a design of such a general nature that it is adapted to being rotated on its side and the rolls introduced into the splicer horizontally from a roll lifting and transport system.

(5) a procedure whereby the chucks may be operatively expanded by a combination of braking torque applied on one chuck and a driving torque applied to the chuck on the other end, thereby actuating the internal mechanisms of a chuck designed to be torque-activated.

Figure 2:
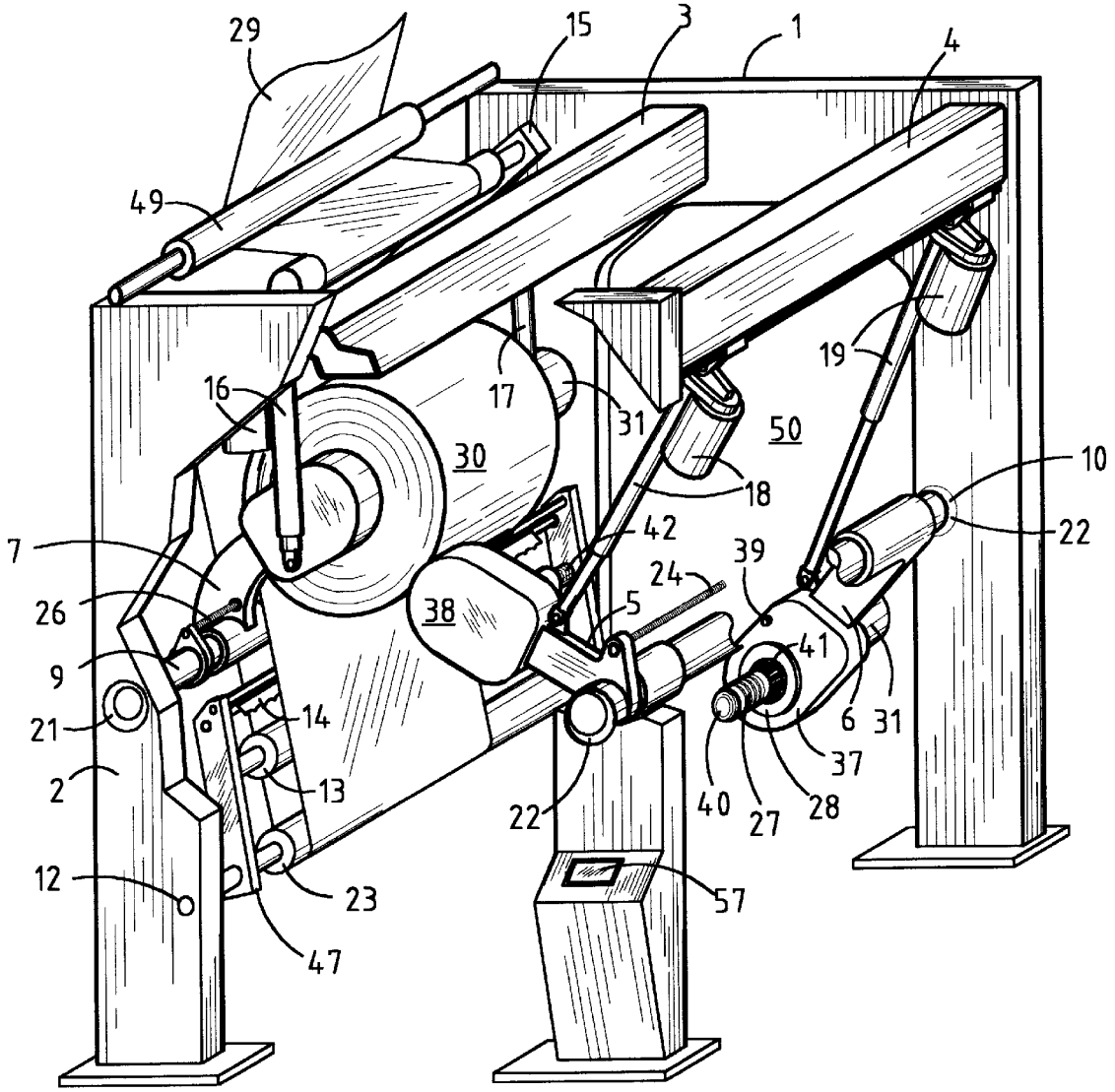
FIG. 2 is a pictorial view showing the splicer in an alternate embodiment with a "pivoting splicehead" with part of the operator side frame cut away to reveal the internal mechanisms.
Figure 3:
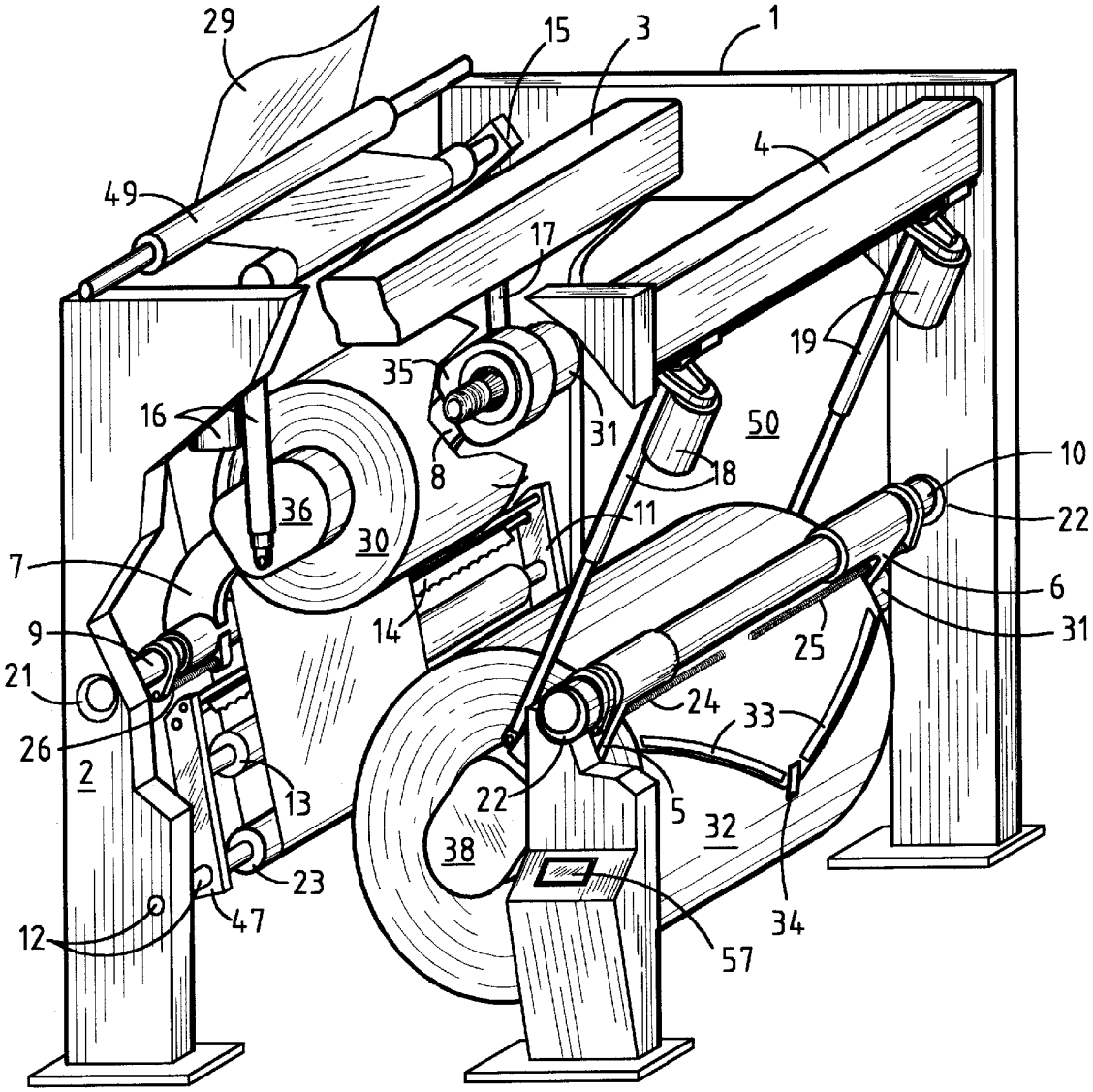
FIG. 3 is a pictorial view showing the splicer with the "pivoting" splicehead, a new roll loaded and part of the operator side frame and part of the left-hand roll cut away to reveal the internal mechanisms.

Referring now to the drawings, the present invention in its preferred embodiment with a linear splicehead and rolls loaded off of floor roll-dollies is shown in FIGS. 1, and 4–8. FIGS. 2 and 3 show the alternate pivoting splicehead, and FIG. 9 is shown as configured to be bottom loaded.

Figure 1:
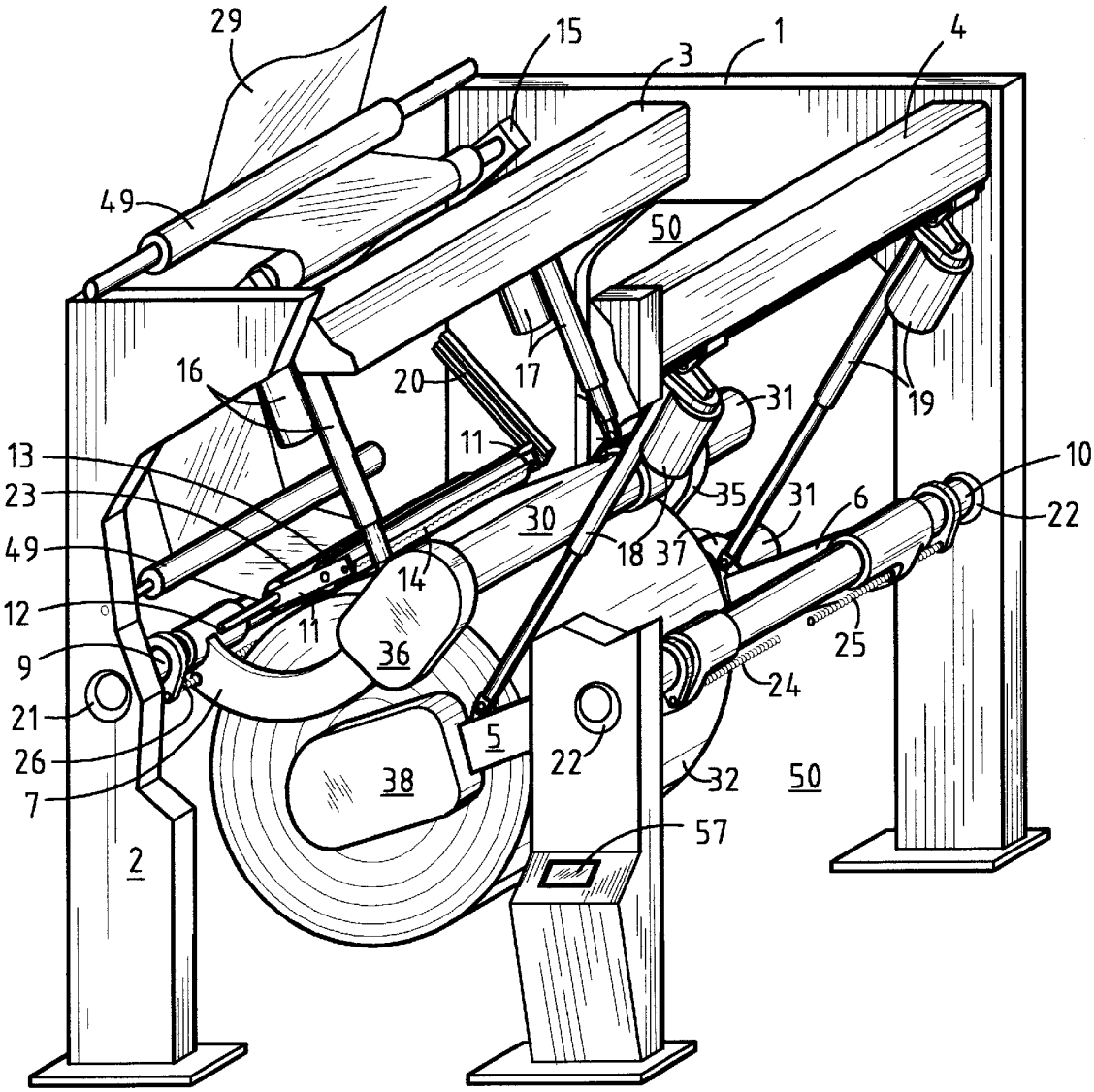
FIG. 1 is a pictorial view showing the splicer in its preferred embodiment with a "linear splicehead" located above the roll and with part of the operator side frame cut away to reveal the internal mechanisms.

FIG. 1 illustrates the apparatus in its preferred embodiment comprising frame plates 1 and 2, loading aperture 50, spaced apart by cross members 3 and 4 to provide a rigid box-like structure or frame supporting four main splicer components: the pivot shafts 9 and 10; the actuators 16, 17, 18 and 19; the preferred embodiment includes a linear splicehead comprising side plate 11, shaft 12, resilient roller 13, severing knife 14, a supporting track, 20, and an idler roller 23 and the dancer 15. The pivot shafts are adjustably supported within the frame plates 1 and 2 by pairs of eccentrics 21 and 22. The actuators are slidably supported on rails extending across the length of, and attached to, cross members 3 and 4, so disposed that they slide in unison with the roll support arms beneath them. New roll 32 is rotatably supported on each end by the chucks on arms 5 and 6 operatively swingable about shaft 10 by linear actuators 18 and 19. Expiring roll 30 is rotatably supported on each end by the chucks on arms 7 (and 8 shown in FIG. 3) which are swingable about shaft 9 by linear actuators 16 and 17. Each of the pair of arms has opposed and rotatable chucks at one end of each arm and is pivoted about a shaft at the other end, said rotatable chucks extending into and expandibly engaging each end of the tubular roll-core on which rolls are commonly wound. On a first end of rolls 30 and 32, rotation of the chuck is controllably restrained by friction brake assemblies 36 and 38 respectively, and by friction brake assemblies 35 and 37 respectively on the second end, said friction brakes acting collectively and in unison with regenerative braking from roll core drive motors 31, to restrain roll rotation, the collective amount of said braking being responsive to signals from the computer to the brake actuating means and to the motor controller, said computer being responsive to a position transducer connected to dancer 15 to provide a constant, predetermined web tension in the exiting web 29. Thus, braking means are located on both ends of the roll, whereas the driving means, which requires substantially less torque, is preferable located on only one end. The driving motor is preferably, but not necessarily located on the side away from the operator.

When the roll 30 is depleted to less than approximately one third its maximum diameter as shown, and said expiring roll is rotating at a high speed, said roll speed accelerates rapidly and may cause an increase in the web tension beyond its predetermined value, even though the brakes are totally released, due to collective inertial mass of the roll core, chuck assemblies and rotating drive components. During this time when the roll is depleted to less than one-third of the maximum diameter, the control of the web tension is normally accomplished solely by the torque of the variable-speed drive motor, which may be used to restrain or accelerate the roll responsive to the position of dancer roll 15 or according to a digitally predictive rate, thereby preventing any variation in the exiting web tension. In the event that it becomes necessary to stop the rolls very rapidly, such as in the case of a web-break or the like, every brake may be applied, to the amount necessary, to assist the drive motors in overcoming the inertia of the rotating rolls so as to rapidly arrest rotation of the rolls. A rapid stop of the expired roll is also required after the splice, to limit the amount of material being unwound after it is cut from the running web and spewing onto the splicer.

Dancer roll 15 is rotatably mounted between the frames and serves to sense the web tension. A pair of load cells, supporting web leading roller 49 and mounted on the frames 1 and 2 may be substituted for the dancer to provide a signal to the computer means which is responsive to the exiting web tension; however, the small movements of dancer have the advantage of absorbing minor transient tension fluctuations, such as those caused by an out-of-round roll, whereas the load cells have only a minute amount of movement.

Linear actuators 18 and 19 rotatably position arms 5 and 6 respectively, and actuators 16 and 17 rotatably position arms 7 and 8 respectively (shown in FIG. 3). Positioning screws 24, 25, 26 (and an additional positioning screw not shown), laterally position arms 5, 6,7 (and 8 shown in FIG. 3) respectively to accommodate rolls of varying widths. Another function of said positioning screws is positioning the exiting web 29 from side to side by simultaneous motion of the arms on both ends of a roll, said motion causing axial roll movement without affecting the engagement of the chucks in the roll cores.

The splicehead, consisting of side plates 11 and shaft 12 which move linearly in slides 20, supported on the insides of side plates 1 and 2, serve to rotatably support resilient roller 13 and severing knife 14 constitute collectively what will be refereed hereafter as the "linear splicehead" The linear splicehead is shown in its extended position, ready to make a splice, wherein it positions resilient roller 13 a distance of ½ inch to 1½ inches from new roll 32, said roll also deflecting web 29 being unwound from roll 30 to a position close to roll 32. A photocell (not shown) is located on the splicehead angling inward toward the middle of the roll to sense the circumferential position of the adhesive pattern on the rotating new roll. When the expiring roll reaches a predetermined minimum value, the computer will issue a signal to splice immediately after the next adhesive pattern has passed the photocell. Upon receiving said signal from said computer means, said resilient roll is rapidly and forcibly pressed against the running web against the surface of roll 32. When the new roll has revolved sufficiently so that adhesive areas 33 (shown in FIG. 3) have traveled under the point of contact of the resilient roller and the new roll, the running web and the leading edge of the web wound on the new roll are co-joined, which tears the tab 34 (shown in FIG. 3) which is used to fasten down the leading edge of the new web and prevent it from unwinding due to aerodynamic drag. At the moment said tabs tear apart, knife 14 severs the connection between the joined webs and the expired roll 30, and said expired roll is then immediately braked to a stop by braking assembly 35 and 36 and motor means 31. A computer means 57 controls most of the actions of the present invention.

FIG. 2 illustrates an alternate mechanism, which will be referred to as the Pivoting Splicehead replacing the preferred Linear Splicehead in the embodiment illustrated in FIG. 1. The side plates 47 pivoting in splicer frame side plates 1 and 2 about shaft 12, resilient roller 13, and its supporting shaft, 42, severing knife 14 and idler roller 23 collectively form a mechanism hereinafter referred to as the "Pivoting Splicehead", which is shown rotated counter-clockwise into its retracted non-operating position. Operating side left-hand roll-supporting arm 7 (and drive side roll-supporting arm 8 shown in FIG. 3) are shown rotated in a counter-clockwise direction by linear actuators 16 and 17 sufficient to allow the right-hand positioning arms 5 and 6 to rotate counter-clockwise past them. Counterclockwise rotation down of arm 5 has been stopped at a point above the area required for the loading of the new roll. Actuator 19 has extended to rotate arm 6 counterclockwise down to the vertical height required for photocell 39 to sense the top of the smallest diameter roll. The operator, or suitable automatic means, will position an end of the new roll inside the frame 2 sufficient close to chuck 40 so that the top of the end face of the roll is sensed by photocell 39. Actuator 19 will then retract causing arm 6 to rotate clockwise up until photocell 39 senses the top of the new roll. The computer control will then compute the location of the center of the roll core, based on the predetermined height of the roll-dolly and the position of said photocell, and issue a control signal to actuator 19 which will lower arm 6 counter-clockwise to a position wherein the centerline of chuck 40 is positioned vertically at the same height as the new roll core. The roll diameter so obtained will also be stored in the memory of the computer for later use.

The new roll is then aligned horizontally, either manually or by automatic means so that the centerline of said new roll and the centerline of chuck 40 are substantially coincident, whereupon the new roll is moved axially to engage onto the chuck. Conical element 41 of the chuck is larger than inside diameter of the roll core, and the axial flutes provided thereon forcibly expand and firmly engage the roll core, centering the roll core on the chuck concomitantly. Actuator 18 then extends to lower arm 5 counter-clockwise to a position wherein its chuck 42 is the same height as opposed chuck 40. Operative means, such as screws 24 (and 25 shown in FIG. 3), then move the arms towards the center of the new roll, thereby forcibly engaging the chucks into the new roll core so disposed that flanges 28, which are provided on all four chucks, contact the end face of the roll and prevent further engagement.

The "chucking means" 40 consists of chuck flange 28, fluted conical element 41, a rounded end element supported on an internal shaft, and between 41 and the rounded end is an expandable element 27 which is expandable responsive to relative motion between said conical element and said rounded end element. The expandable element of some commonly available chucks are comprised of an external sleeve of an outside diameter that may be easily inserted into standard roll cores, and having openings through which moveable elements protrude radially outward responsive to a central shaft having cam surfaces so disposed that movement of said shaft relative to the sleeve cams said moveable elements outward, thereby engaging a surrounding roll core. Similar devices having minor variations are commonly available from various manufacturers. For use in this invention, a releasable locking means will be added to selectively retain said chuck in its expanded condition, responsive to a signal from the computer by rotationally restraining relative motion between the exterior element of the chuck and the internal caming element.

Referring now to FIG. 3, roll 32 is then raised off its supporting dolly at the roll loading position (shown in FIGS. 4 and 6) by a simultaneous and equal retraction of actuators 18 and 19 causing clockwise rotation of arms 5 and 6 until the roll reaches a splicing position responsive to its diameter, which was stored in the memory of the computer.

FIG. 3 shows the splicer as customarily disposed during operation, with the exiting web 29 being fed from roll 30, after having traversed a plurality of idler rollers 49. The new roll 32 is now shown raised sufficiently to allow removal of the dolly from the roll loading position. One of the numerous common ways of preparing the outer wrap of a new roll for splicing is illustrated, which will be familiar to those versed in the operations of splicers. The leading end of the outer wrap of the new roll 32 is retained during the time that the roll is being rotated prior to splice by breakable tab 34 and the leading edges prepared by the addition of adhesive areas 33

Figure 4:
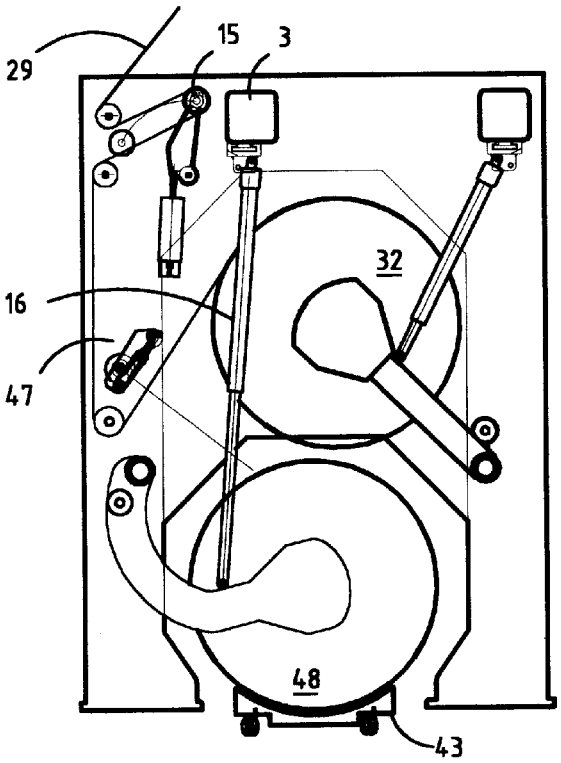
FIG. 4 shows diagrammatically the splicer in FIG. 1 at the beginning of the run with a new roll just loaded and still supported on a roll-dolly, with the "linear" splicehead retracted and with the roll in the right-hand pair of arms partly depleted.

FIG. 4 shows diagrammatically a side view of the splicer with roll 32 beginning to unwind. New roll 48 was inserted into the roll loading position and is still supported on roll-dolly 43. Next, the left-hand arms will move together axially, thereby engaging their chucks into the core of roll 48 prior to raising the roll into the position shown in FIG. 5.

Figure 5:
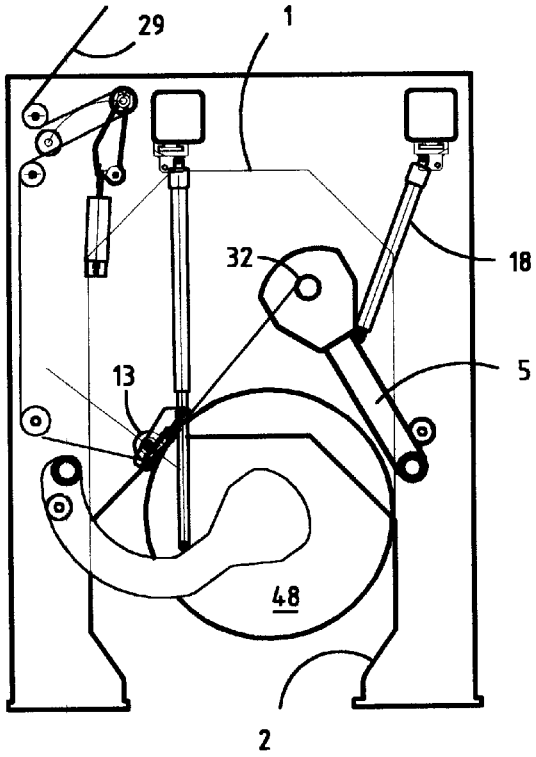
FIG. 5 shows diagrammatically the roll in the right hand pair of arms nearly expired with the "linear" splicehead positioned to splice the end of that roll onto the new roll which is supported by the left-hand pair of arms.

Referring now to FIG. 5, the unwinding roll 32 will soon be expired. The new roll 48 is positioned a predetermined distance from resilient roller 13 in preparation for the splicing operation, and is accelerated to a speed such that the surface velocity of the roll surface equals the running web velocity. At a predetermined size for expiring roll 32 the splice will be initiated as heretofore described for roll 32.

Figure 6:
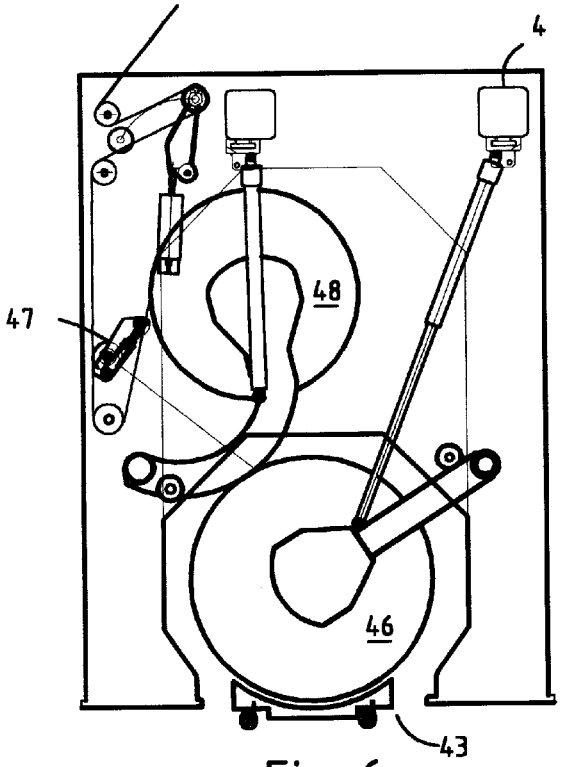
FIG. 6 shows diagrammatically the position of the left-hand roll as a new roll is being loaded into the right-hand arms from a roll-dolly.

FIG. 6 shows the preferred embodiment with the Linear Splicehead in its retracted position. The roll 48 in the left-hand pair of arms is raised sufficiently to allow the right-hand pair of arms to bypass them on the way downward to engage the new roll 61, which is supported by dolly 43.

Figure 7:
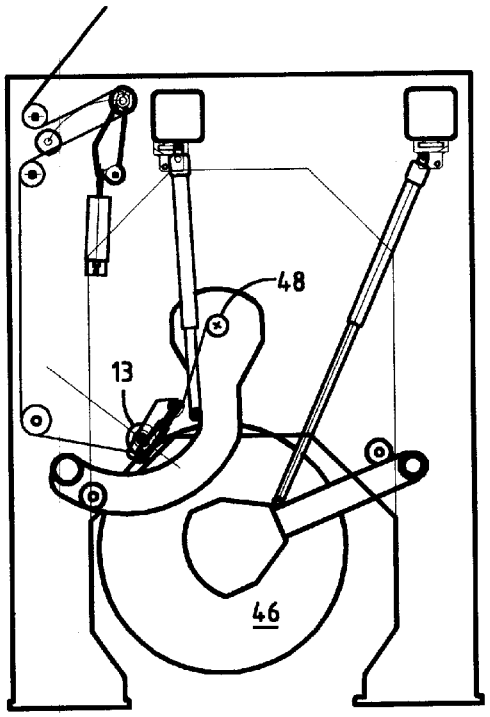
FIG. 7 shows diagrammatically the rolls in their preferred splicing position, and the "linear" splicing mechanism extended near the new roll just prior to splice.

In FIG. 7, the linear splicehead has been extended in preparation for splicing, and the running roll 48 is nearly depleted. The new roll 46 has been lifted from the dolly and positioned for splicing. When the diameter of roll 48 is reduced to a predetermined size, a splice will be made as heretofore described.

Figure 8:
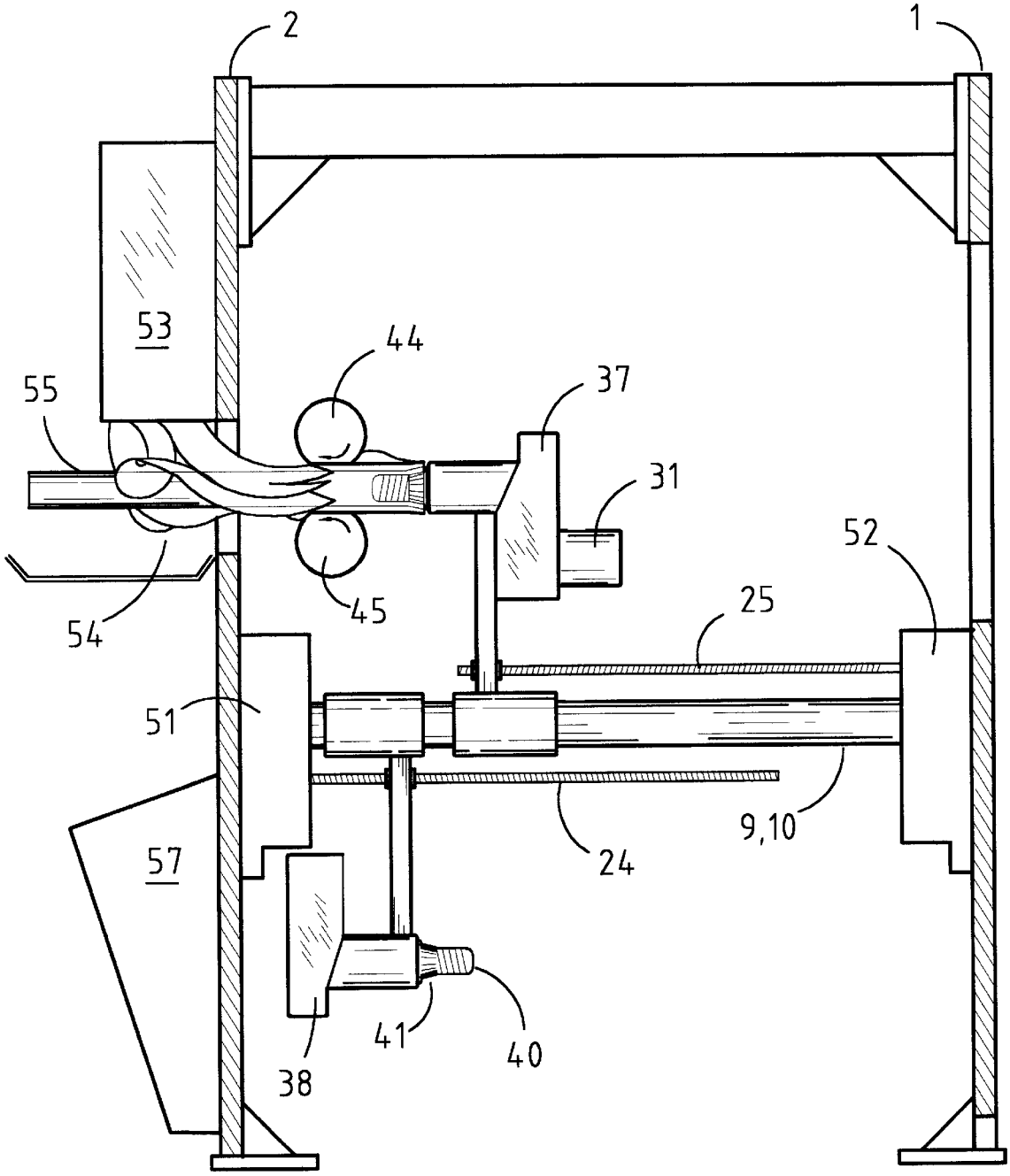
FIG. 8 is an end elevation showing the butt roll extending out through an opening in the frame, and being removed from the chuck and ejected.
Figure 9:
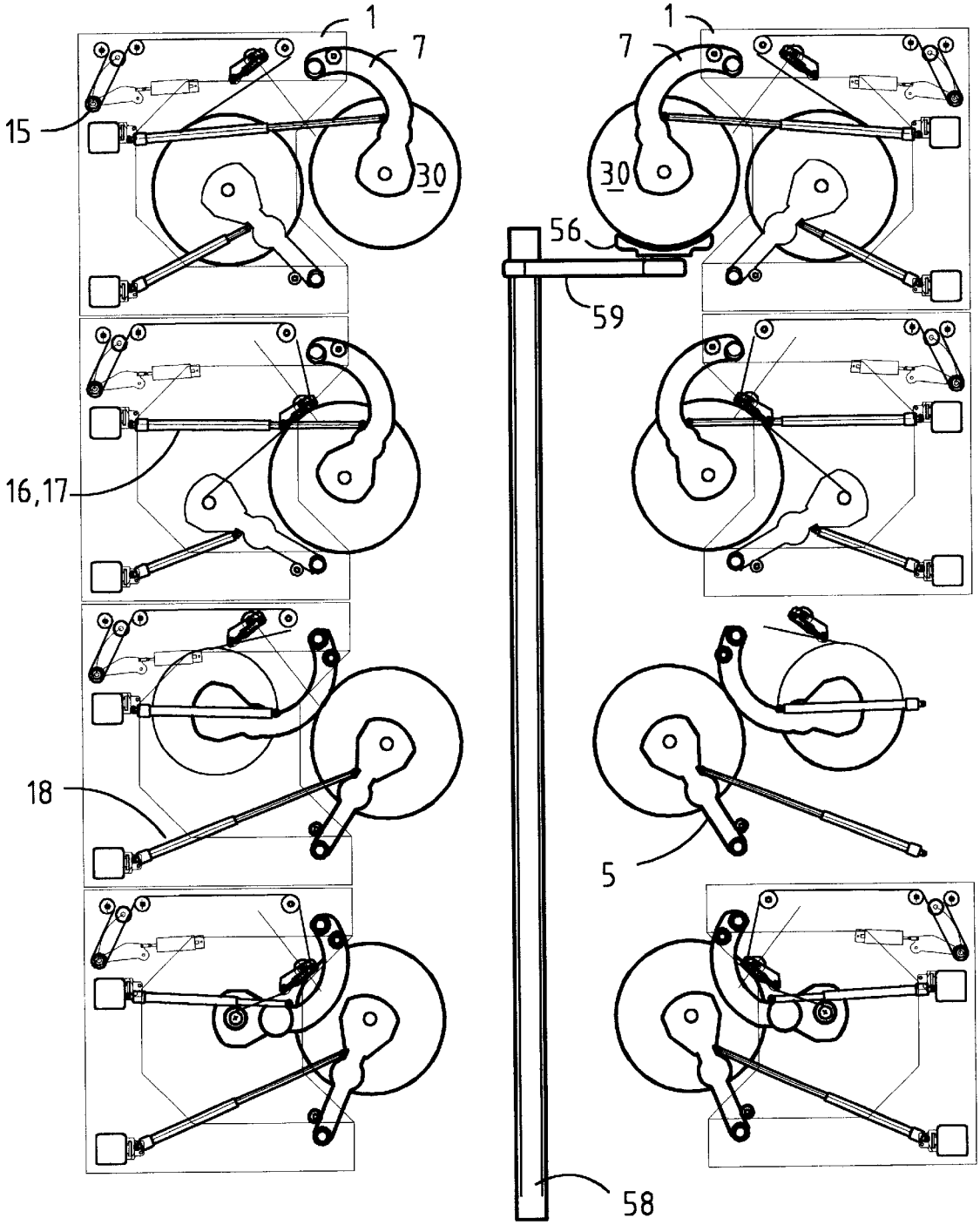
FIG. 9 is a side view of a plurality of machines according to the preferred embodiment with the "linear" splicehead, as configured for side loading in a vertically stacked arrangement, and a roll loading device.

Referring to FIG. 8, after a splice has been made, chuck 40 on the operator side is shown disengaged from roll core 55. The roll core continues to be supported by its opposed chuck, which is driven by motor 31 on the driven side. The roll support arms are then deliberately miss-aligned, and the arm still supporting the core 55 is rotated to a position where the roll core extends between rollers 44 and 45, and is gripped thereby. Drive means 31 then rotates the butt roll wound on core 55 in the direction which causes the butt roll to unwind, and the web remaining thereon 54 to be drawn off by the rotation of rolls 44 and 45. Assisting in the removing of said web is a suction and shredding fan located in duct 53. After removal of said remaining web, the core is operatively disengaged from the chuck, and rollers 44 and 45 grip the core and continue to rotate to draw the core off of the chuck and expel it through the frame into a suitable accumulating means. Covers 51 and 52 enclose actuators 16,17,18, and 19.

Yet another aspect of this invention is shown in FIG. 9 wherein the entire splicing machine may be rotated a quarter of a revolution to produce machines which may be stacked vertically to reduce the floor length of the press row. Two stacks of four machines each with a central roll-lifting mechanism are shown, with the new roll illustrated in the position to load into the top right-hand splicer. This configuration for side-loading requires a special horizontally traversing cradle support arm 59 supporting roll cradle 56 and vertically moveable support by elevating structure and mechanism 58. The new roll is rolled into said roll cradle at a central position in line with 58, with its axis parallel to the direction of web travel. It is then prepared for splicing by the addition of the aforementioned adhesive and tab, rotated one-quarter of a revolution, and raised to the appropriate level to be loaded into the desired stacked splicer, where it is positioned side-to-side by arm 59 so disposed that its roll core may then be engaged by the chuck in the roll support arm 7.

What is claimed is:

1. Apparatus for handling rolls of material wrapped around a hollow core without the use of a core shaft through the center of the roll, which comprises:

means for supporting parallel first and second pivot shafts, each of which support two pivoting arms;

a spaced first and second pivoting arm means, each arm being independently movably hinged at one end of the shaft about a first pivot shaft, each arm having a chuck parallel to said pivot shaft at the other end for rotatably supporting the first and second ends of a first web supply roll, said first arm being the operator side arm, which is the side of the apparatus through which the new web roll is inserted, and the second arm being on the other end of the roll being the drive side arm;

a spaced third and fourth pivoting arm means, each arm being independently movably hinged at one end thereof about a second pivot shaft, each arm having a chuck parallel to the said pivot shaft at the other end for rotatably supporting the first and second end of a second web supply roll, said third arm being a operator side arm and said fourth arm being a drive side arm;

a chucking means, attached to each of the four pivoting arms, which may be inserted into the ends of a hollow core of a roll and which operatively grips the internal surface of the central core of the roll and may also engage the ends of the core and roll;

a roll loading position located between said pivot shafts;

a computer means for determining, which pair of pivoting arms are not currently in use holding a web roll which will be used to engage a new web roll, the appropriate axial position of each of said pair of pivoting arms which are to be used to engage a specific web roll, which is responsive to the web supply roll width, roll diameter and the desired axially positioning of said roll;

means for determining the diameter and center of a newly loaded roll, and lifting means to position the center of the drive side chuck at the same elevation as said roll center;

operative means for independent axial positioning of each of the four pivoting arm means along its respective pivot shaft, responsive to said computer means;

motor means for selectively driving and braking the new roll to a rotational velocity such that the surface velocity of the new roll corresponds to the velocity of the exiting web;

computer controlled lifting and positioning of the operator side chuck co-axial to the drive side chuck and insertion and engagement of the operator side chuck into the new roll;

lifting means to position said first and second arms responsive to the diameter of the first new supply roll which they are rotatably supporting, so disposed as to position the surface of the new roll in proximal juxtaposition to the surface of the expiring web to facilitate automatic splicing in the conventional manner; and lifting means to position said third and fourth arms responsive to the diameter of the second web supply roll which they are rotatably supporting, so disposed as to position the surface of the new roll in proximal juxtaposition to the surface of the expiring web for automatic splicing in the conventional manner.

2. Apparatus as described in claim 1, including means for automatically expelling said depleted rolls and cores from the interior of the apparatus.

3. Apparatus as described in claim 1, including a computer means for determining the diameter and center of newly loaded roll and lifting means to position the center of the drive side chuck to enable a new roll core to be loaded and engage said chuck at the same vertical elevation as said roll center.

4. Apparatus as described in claim 1, including means for supporting the core of the roll using chucks attached to the pivoting arms of the apparatus which are fastened on each side of the core of a roll of material.

5. Apparatus as described in claim 1, where the computer and an operative positioning means move an automatic splicing mechanism from its retracted position into proximal juxtaposition with the new roll, so disposed as to concurrently relocate the path of the expiring web into proximal juxtaposition with said new roll.

6. Apparatus as described in claim 1, where the motor means to brake and accelerate the rotation of the chucks supporting the depleting roll responds to an exiting web-tension sensing means so disposed as to provide a regulated exiting web tension.

7. Apparatus as defined in claim 1, wherein the path of the roll as it moves between operational positions is such that the roll is disposed within a space defined by the width of the frames in the direction of the web, said width being substantially less than twice the maximum new roll diameter.

8. Apparatus as defined in claim 1, wherein the control means for determining the diameter of the new roll consists of photocells supported on both drive side pivoting arms so disposed that the sensing beam of a photocell is angled across the central top of the new roll during loading of said roll, which senses the presence of said roll, means to measure the elevation of the arm being loaded with said new roll;

and computer means responsive to the signal from said photocell, thereby computing the elevation of the top of the roll, and hence the new roll diameter.

9. Apparatus as defined in claim 1, wherein the chuck on the pivotal arm on the operator side is disconnected by rotation of the chuck on the drive side and the roll engaged thereto to release the operator side chuck, and the arm on the drive side is lifted by the lifting means so disposed that the center of the expired roll is aligned between two rollers which convey the depleted core through the rollers on the operator side, said core being urged by the chuck on the drive side arm moving toward the operator side; the chuck on the drive side releases the core, allowing transfer by a plurality of spaced rollers, at least some of which are movably supported and responsive to the diameter of said depleted expired roll and core, and said rollers compress together against the surface of the expired roll, and operatively rotated in opposite directions so as to engage an expired roll inserted between said rollers, transporting said expired roll away from the chuck on the drive side once the chuck is unlocked and released by reverse rotation of the drive motor on the driven side acting against the braking torque of the brakes on the same arm.

10. Apparatus as defined in claim 1, wherein the depleted roll is released and transferred away from the operating side chuck, said chuck being lowered to the load position, and the drive side arm, motor means, and chuck engaged into a core having a scrap remnant material still wound thereon are collectively positioned vertically midway between a plurality of rollers, at least some of which are movably mounted responsive to the diameter of said depleted roll and so disposed as to frictionally grip said scrap remnant, said motor means then being rotated counter to the direction that said material was wound on said core, said rotation of said core causing the material wound thereon to unwind and be transferred from said roll core by plurality of spaced rotatable rollers, and the drive side chuck becomes unlocked by rotating the chuck after the expired roll is substantially engaged with the set of rollers.

11. Apparatus as defined in claim 1, for actuating and expanding a torsionally activated operator side chuck by rotating the roll by driving the drive side chuck with the motor engaged thereto and rotationally braking the chuck engaging an operator side of said new roll and supported on a spindle and inserted into a new roll and core by sequentially:

engaging the drive side of the roll with a drive side chuck and, inserting an operator side chuck having affixed thereto a flange with a roughened surface into the roll core on the operator side and urging said flange drivingly against the operator side end face of the roll, activating a brake attached to the said operator side spindle, and rotating said roll with said drive side chuck, thereby producing a relative motion between said braked spindle and said operating side chuck, said relative motion actuating a mechanism so disposed as to expand said operator side chuck, thereby gripping the interior of the roll core.

12. Apparatus as defined in claim 1, wherein said first and said second pivot shafts are each supported on both of their ends by eccentric means, so disposed that operative rotation of said eccentric means repositions the center lines of the said pivot shafts thereby relocating transversely the pivoting arms rotatably supported thereon, the chucks attached to said arms being thereby centered on the new roll prior to engagement of the chuck into said roll core, preferably responsive to control information from the computer.

13. Apparatus as defined in claim 1, wherein the entire apparatus has been rotated one-quarter of a revolution so disposed that the rolls are loaded into the apparatus horizontally by a roll elevating and positioning means, thereby permitting a plurality of apparatae to be stacked vertically.

14. An apparatus as described in claim 1, including apparatus to sequentially: disengage and extract axially the operator side chuck from the core of the expired roll, and continue to move said chuck to its extreme position at the operator side of the apparatus, and lower said chuck to an elevation substantially beneath the lower surface of the expired roll, and convey said expired roll and core towards the operator side while supported by the drive side chuck in a cantilevered manner with respect to the drive side chuck and pivot arm, and loosen said drive side chuck from the expired roll and core for later disengagement and removal of said expired roll and core from the apparatus.

15. An apparatus as defined in claim 1, wherein the depleted roll is sequentially:

disengaged from its operator side chuck, said operator side chuck, and the arm by which it is supported, are lowered to their lowest possible position the drive side arm, the chuck supported thereby, the depleted roll and the core engaged to said chuck, position the center of said depleted roll and core midway between a plurality of rollers, at least some of said rollers being movably mounted responsive to the diameter of said depleted core, being operatively and selectively urged together, and said roll and core are pushed between said rollers by operative axial movement of said arm and the chuck supported thereby, said rollers being operatively rotatable in opposite directions so disposed as to drivingly engage the longitudinal surface of an expired roll inserted between said rollers, said drive side chuck being operatively rotatable counter to the direction said material on the expired roll is wound onto the core, said rotation of said core causing the material wound thereon to unwind and be removed from said roll core by a plurality of spaced rotatable rollers, and the drive side chuck is disengaged from the core after the paper is removed from said core, allowing said plurality of rollers to drivingly urge said core through and out from between said rollers.

16. Apparatus as defined in claim 1, including an apparatus for actuating and expanding a torsionally activated chuck inserted into a new roll and core by sequentially engaging the brake affixed to the drive side chuck which is allowed to rotate on a supporting spindle, said brake thereby resisting rotation of said chuck, and rotating said spindle with a motor, thereby producing motion between said spindle and said braked chuck, said motion actuating a means so disposed as to expand said drive side chuck, thereby gripping the interior of the roll core.

* * * * *